United States Patent [19]

Yang

[11] Patent Number: 4,462,232

[45] Date of Patent: Jul. 31, 1984

[54] COMBINATION LOCK FOR LUGGAGE CASES

[76] Inventor: Gwo T. Yang, No. 11, Alley 23, Kuan San La., Kung Kuan Rd., Pei Tau, Taipei, Taiwan

[21] Appl. No.: 370,230

[22] Filed: Apr. 20, 1982

[51] Int. Cl.[3] ..... E05B 37/02

[52] U.S. Cl. ..... 70/312; 70/316

[58] Field of Search ..... 70/312, 316, 287, 288

[56] References Cited

U.S. PATENT DOCUMENTS

| | | | |
|---|---|---|---|
| 3,411,330 | 11/1968 | Atkinson | 70/312 X |
| 3,707,861 | 1/1973 | Lindner | 70/312 X |
| 3,845,644 | 11/1974 | Lindner | 70/312 X |
| 3,851,507 | 12/1974 | Gehrie | 70/312 X |
| 3,893,313 | 7/1975 | Kobayashi | 70/287 X |
| 3,973,419 | 8/1976 | Atkinson | 70/312 X |
| 4,198,837 | 4/1980 | Gisiger | 70/312 X |
| 4,249,469 | 2/1981 | Craske | 70/312 X |
| 4,324,120 | 4/1982 | Gisiger | 70/312 |

*Primary Examiner*—Thomas J. Holko

*Assistant Examiner*—Thomas J. Dubnicka

*Attorney, Agent, or Firm*—Tak K. Sung

[57] ABSTRACT

A combination lock for luggage cases, comprising a frame, to be mounted on one part of the luggage case, a lock plate provided with a plurality of lock lugs, a plurality of lock wheels each having a slot to be selectively engaged with a corresponding one of the lock lugs, the lock wheels each being provided with a dial wheel, the dial wheels being laid flat side by side on the frame and having an upper surface carrying a group of code figures arranged in a circle. The lock plate is further provided with a hook means for engaging and disengaging a hasp member provided on another part of the luggage case. When the lock wheels are rotated to align the slots with the lock lugs, the lock plate is free to move so that the hook means can be moved toward and away from the hasp member. When the lock wheels are rotated to cause the slots to be out of alignment with the lock lugs while the hook means if engaged with the hasp member, the movement of the lock lugs, the lock plate and the hook means is blocked thus locking the lock.

3 Claims, 9 Drawing Figures

COMBINATION LOCK FOR LUGGAGE CASES

BACKGROUND OF THE INVENTION

This invention relates to combination locks for luggage cases and the like.

Conventional combination locks for luggage cases and the like are generally provided with a plurality of (normally three) dial wheels arranged co-axially, each dial wheel having ten numbers of 0 to 9 around the periphery thereof, such as the one disclosed in U.S. Pat. No. 3,416,388. To use such a lock, the lock is first pre-set with a given combination of numbers and the lock is locked when the dial wheels are rotated to any position other than the pre-set combination of numbers. The lock is then unlocked when the dial wheels are rotated to the position where the pre-set combination of numbers is aligned. However, in this arrangement the peripheral part which enables the manipulation of the dial wheel protrudes outwardly without any protection against contact with other articles and there is therefore a chance that the dial wheels will be rotated by accident and the lock locked when one does not want the lock to be locked. Furthermore, the co-axially arranged dial wheels make the construction of conventional combination locks complicated.

Therefore, the main object of this invention is to provide a combination lock for luggage cases and the like, having dial wheels arranged side by side and flatly so that there is less chance of causing the dial wheels to rotate by accidental contact with other articles.

Another object of this invention is to provide a combination lock for luggage cases and the like having a less complicated construction.

DETAILED DESCRIPTION OF THE INVENTION

Figure 1:
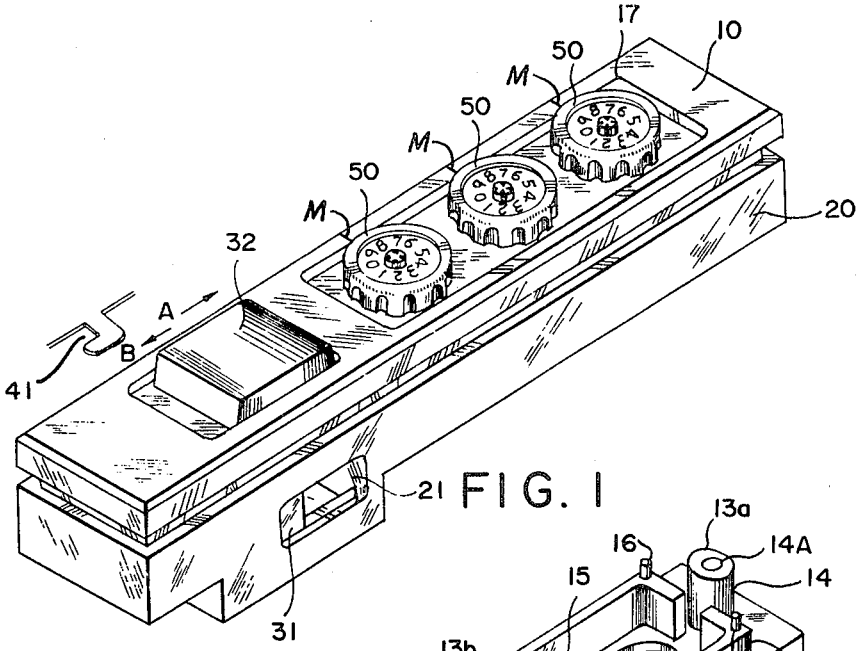
FIG. 1 is an oblique, perspective view of the combination lock for luggage cases of this invention.
Figure 2:
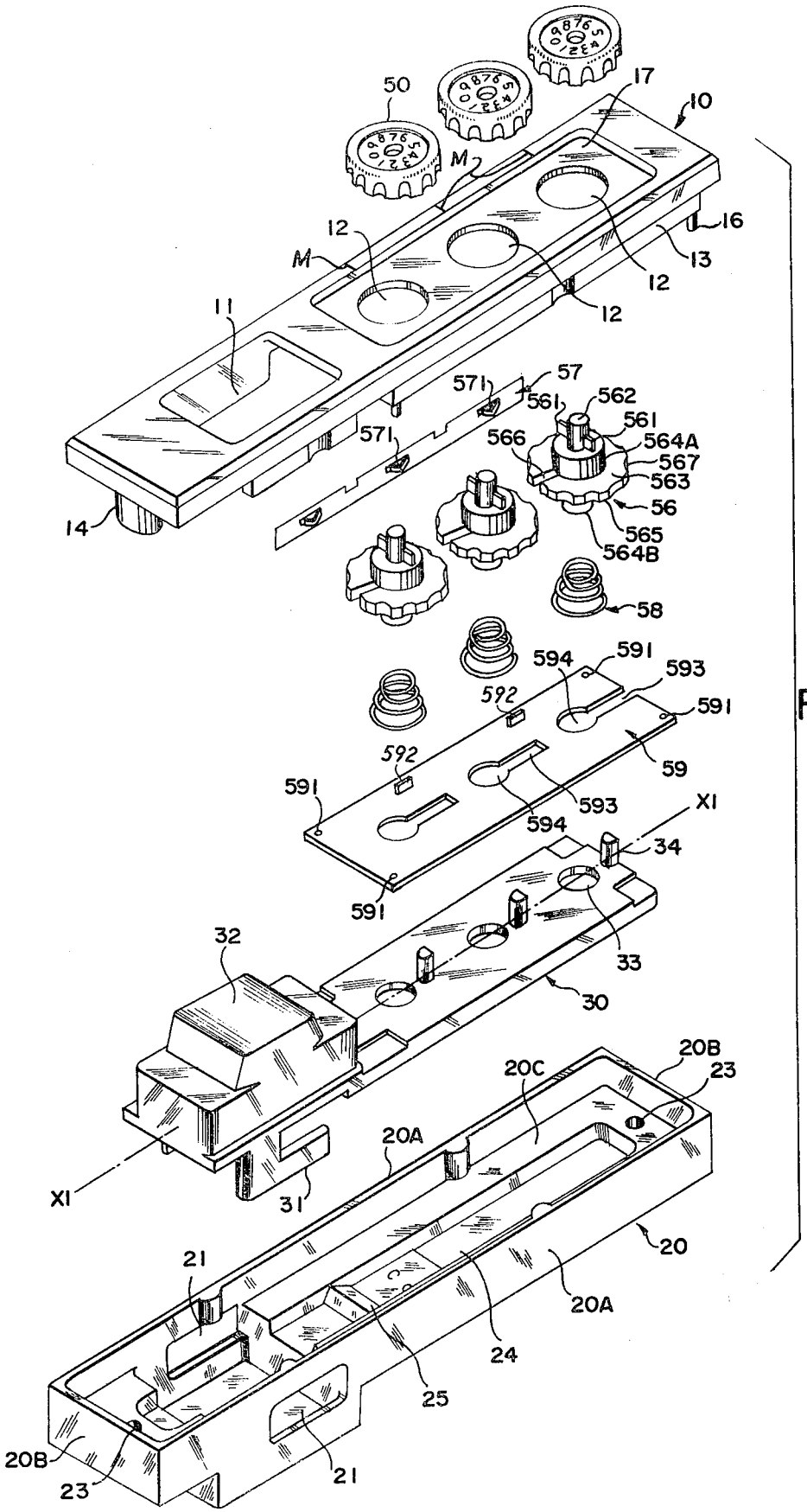
FIG. 2 is an exploded, oblique, perspective view of the combination lock as shown in FIG. 1.

In FIGS. 1 and 2, there is shown an embodiment of the combination lock of this invention, which comprises: a frame 10, base 20 adapted to be mounted on the outer surface of a panel of a luggage case body (not shown); three dial wheels 50 rotatably mounted flat and side by side on the upper surface of frame 10; a lock plate 30 having a hook 31 and a knob 32; hook 31 being arranged to engage with a hasp member 41 provided on an opposite part which may be a cover of a luggage case, not shown, when the luggage is closed and hasp member 41 is inserted into hole 21 formed in base 20; dial wheels 50 each being provided with a lock wheel 56 operable by dial wheel 50 to cooperate with lock plate 30, to be described later, for locking and unlocking the lock. The combination lock of this invention further comprises a coil spring 58 for each lock wheel 56, a leaf spring 57 and a retaining plate 59 having three holes 594 to be described later.

Figure 3:
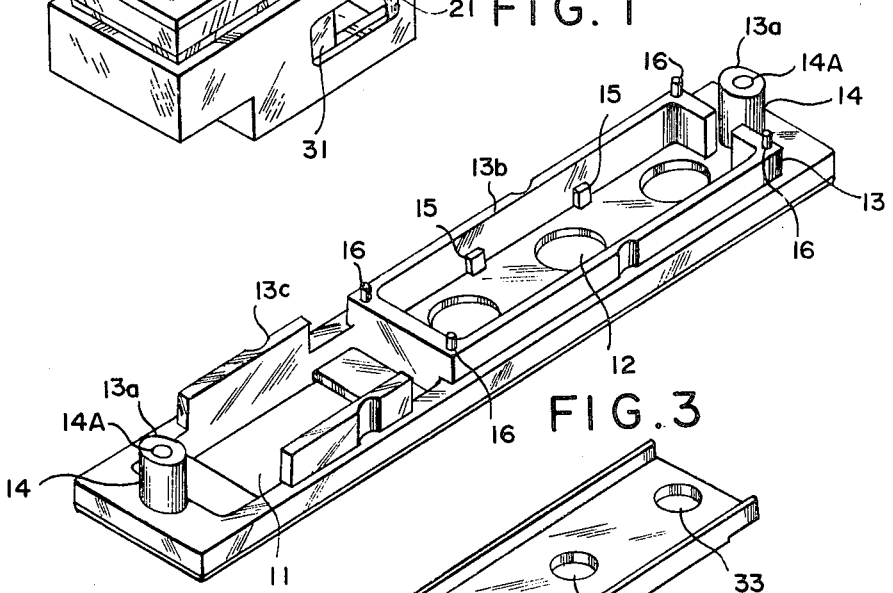
FIG. 3 is an oblique, perspective view of the frame of the combination lock as shown in FIG. 1, being turned upside down to show the detail of its inner side.
Figure 4:
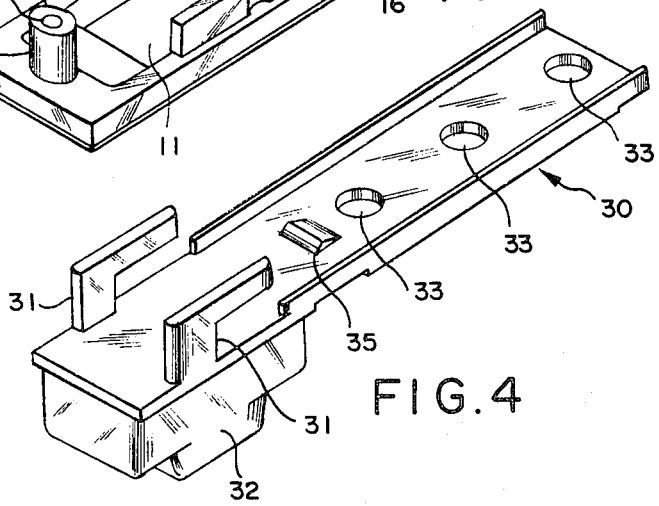
FIG. 4 is an oblique, perspective view of the lock plate of the combination lock as shown in FIG. 1, being turned upside down to show the detail of its lower side.

Frame 10 as shown in FIGS. 2 and 3 is provided with an opening 11 generally in rectangular shape; a generally rectangular, planar surface 17 on one side of said opening 11, three circular holes 12 arranged side by side and longitudinally in line in said planar surface 17 on one side of opening 11; a mounting post 14 having therein a screw-threaded hole 14A at each end of the inner side; a generally rectangular flange 13 integrally formed therewith on the bottom surface thereof to surround the three circular holes 12; and four studs 16 formed on four corners of rectangular flange 13. (FIG. 3).

Base 20 as shown in FIG. 2 is formed into a generally rectangular box shape and provided with two side walls 20A, two end walls 20B, a bottom 20C having a recess 24, and a mounting hole 23 in each end of bottom 20C. At a suitable place in each side wall 20A there is provided a side opening 21 as shown in FIG. 2. At a suitable place in recess 24 there is provided a leaf spring 25 to be described later.

Lock plate 30 as shown in FIG. 2 is formed into a generally rectangular shape and adapted to be slidably disposed in base 20 and capable of moving along a longitudinal axis XI—XI for a suitable distance, and provided with a knob 32 on the upper side thereof to correspond with opening 11 of frame 10, a pair of hooks 31 on the bottom side to correspond laterally with side opening 21, three circular holes 33 to correspond with three circular holes 12 in frame 10 when lock plate 30 is moved to the position where hasp member 41 is disengaged from hook 31. In the vicinity of each circular hole 33 opposite to knob 32 there is provided a lug 34 generally in line with the common longitudinal axis XI—XI of the three circular holes 33.

In a suitable position on the bottom side of lock plate 30 there is formed a convex 35 to cooperate with leaf spring 25 provided one base plate 20, leaf spring 25 being formed with a peak to be described later.

Figure 8:
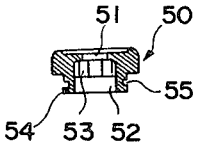
FIG. 8 is a longitudinal, cross-sectional view of a dial wheel of the combination lock of FIG. 1.

Dial wheels 50 as shown in FIG. 2 are each provided with a group of code figures, which may be ten numbers of 0 to 9, on its upper surface around its center, a center hole 51 and a boss 54 extending from its bottom side as shown in FIG. 8 adapted to rotatably fit into one of the three circular holes 12 of frame 10, boss 54 having a bore 52 larger than center hole 51, said bore 52 being provided with a plurality of recesses 53 having the same number as the number of code figures shown on the upper surface of dial wheel 50, which is ten; said recesses being equally spaced around the center axis of said bore 52 and center hole 51. Boss 54 as shown in FIG. 8 is further provided with a groove 55 around the outer periphery to receive a snap ring 55A as shown in FIG. 6, so as to rotatably retain dial wheel 50 on frame 10.

Figure 6:
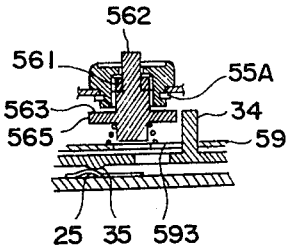
FIG. 6 is a longitudinal, cross-sectional view of a dial wheel assembly, showing the lock wheel being in a position to block a lock lug.

Lock wheels 56 as shown in FIGS. 2 and 6 are each provided with a disc 563 having a slot 566 cut radially and nine concaves 567 equally spaced around the periphery thereof; a convex 565 formed between each two neighboring concaves 567; an upper stem 564A perpendicularly extending from the upper side of disc 563; a central rod 562 on the upper end of upper stem 564A; and a lower stem 564B perpendicularly extending from the lower side of disc 563; central rod 562 having keys 561 capable of selectively engaging with and disengaging from recesses 53 in bore 52 of dial wheel 50 (FIG. 8), central rod 562 also having an end portion adapted to extend through center hole 51 of dial wheel 50. Lower stems 564B are each so shaped to fit one of three holes 594 provided in retaining plate 59 to be described later and one of the three holes 33 provided in lock plate 30 as described above.

Retaining plate 59 as shown in FIG. 2 is generally formed in rectangular shape having four mounting holes 591 into which studs 16 of frame 10 fit for mounting retaining plate 59 onto frame 10 from below, three holes 594 each having a center axis aligned with each circular hole 12 of frame 10 respectively, each hole 594 being so shaped as to receive therein a lower stem 564B of lock wheels 56 from above, each hole 594 having slot 593 through which lug 34 of lock plate 36 may extend and move therealong. Retaining plate 59 is further provided with projections 592 near one side edge thereof to hold a leaf spring 57 to be described later.

Figure 5:
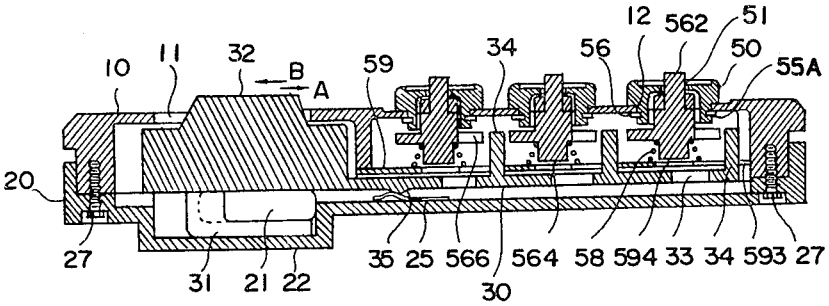
FIG. 5 is a longitudinal, cross-sectional view of the combination lock as shown in FIG. 1, showing an unlocked position.

As shown in FIG. 5, dial wheels 50 are mounted side by side on frame 10, with boss 54 of each dial wheel 50 rotatably inserted through hole 12 and retained by a snap ring 55A. Each dial wheel 50 is provided with a lock wheel 56 assembled from below with central rod 562 extending through central hole 51 of dial wheel 50 and keys 561 engaging with recesses 53 of dial wheel 50. Retaining plate 59 is assembled to frame 10 from below so as to enclose lock wheels 56 in a compartment formed between frame 10 and retaining plate 59. Each lock wheel 56 is provided with a coil spring 58 over and around lower stem 564B to urge lock wheel 56 towards dial wheel 50. Lock plate 30 is assembled to retaining plate 59 from below with knob 32 extending through rectangular opening 11 formed in frame 10 and lugs 34 each extending through respective slot 593 formed in retaining plate 59 and being disposed adjacent to discs 563 of corresponding lock wheel 56. Base 20 is attached to frame 10 from below and fastened thereto with cap screws 27.

Leaf spring 57 as shown in FIG. 2 is provided with three tongue pieces 571 each cut and formed into an L-shaped, each tongue piece 571 being adapted to produce a resilient, lateral pressure on each lock wheel 56 respectively and to engage one of the concaves 567 formed around each lock wheel so as to produce a "click" action when lock wheel 56 is rotated and also to keep lock wheel 56 in position.

Figure 7A:
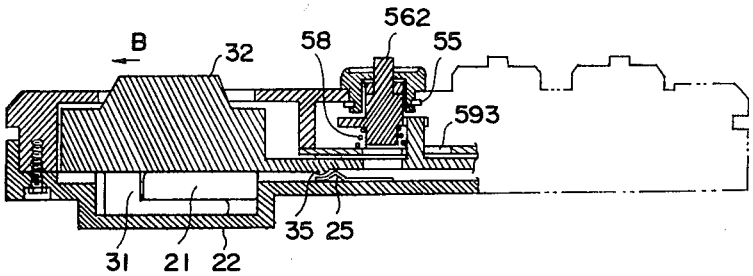
FIG. 7A is a fragmentary, cross-sectional view of the combination lock of FIG. 1, showing a step for changing the combination of numbers.

Convex 35 on the bottom side of lock plate 30 and leaf spring 25 on base plate 20, as shown in FIGS. 5 and 7A, are so designed that convex 35 slides over to one side of the peak of leaf spring 25 when lock plate 30 is moved in direction A, or towards a locked position; and slides over to the opposite side of the peak of leaf spring 25 when lock plate 30 is moved in direction B, or towards an unlocked position, so as to produce a click action when lock plate 30 is moved in either direction to keep lock plate 30 in either position.

Each lock wheel 56 assembled with a dial wheel 50, frame 10, retaining plate 59, lock plate 30 and base plate 20 can be rotated by rotating dial wheel 50. When dial wheels 50 are rotated to align slots 566 of three lock wheels 56 with lugs 34 of lock plate 30 the lugs 34 can be moved in and out of slots 566 thus allowing lock plate 30 to move longitudinally as shown in FIG. 5 and the combination lock is unlocked. When slots 566 of three lock wheels 56 are not aligned with lugs 34, the movement of lugs 34 of lock plate 30 is confined to the space between two neighboring discs 563 of lock wheels 56, so as to block the movement of lock plate 30, as shown in FIG. 6, and the combination lock is locked.

Figure 7B:
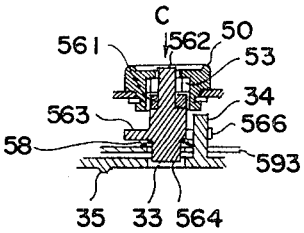
FIG. 7B is a cross-sectional view of a dial wheel assembly, showing another step for changing the combination of numbers.

Slot 566 of each lock wheel 56 can be selectively "indexed" to one of the code figures or numbers provided on respective dial wheel. To do that, slots 566 of all three lock wheels 56 are first aligned with lugs 34 of lock plate 30. Then lock plate 30 is moved in direction B to its "unlocked" position, where holes 33 of lock plate 30 are aligned with corresponding holes 594 of retaining plate 59 and corresponding lower stems 564B of lock wheels 56, as shown in FIG. 7A, enabling lower stem 564B to move into hole 33 if pushed down from above. Then, central rod 562 of each lock wheel 56 is pushed downwards to disengage keys 561 from recesses 53 as shown in FIG. 7B, to allow dial wheel 50 to rotate freely. Dial wheel 50 is then rotated while central rod 562 of lock wheel 56 is depressed until a desired number of the ten numerals on dial wheel 50 is aligned with mark M (FIG. 1) provided on frame 10. Central rod 562 is then released and allowed to move up by the force of coil spring 58, causing keys 561 to engage with recesses 53. Dial wheel 50 is thus again "keyed" to lock wheel 56.

The aforesaid "indexing" process is initially performed before the combination lock is assembled. For example, dial wheels 50 are arranged to align the number "0" with mark M when slots 566 of all three lock wheels 56 are aligned with lugs 34 of lock plate 30 before the assembly of the combination lock is completed. Then each dial wheel 56 can be re-indexed as desired to form a desired combination, and the combination can be changed by repeating the aforesaid "indexing" process.

While a preferred embodiment of the combination lock of this invention has been described for illustration purposes, however, it is to be understood the construction and arrangement of the combination lock can be modified without departing from the spirit and scope of this invention as defined by appended claims.

What is claimed is:

1. A combination lock for a luggage case, comprising:

a frame having an opening and a planar surface at one side of said opening, said frame being adapted to be mounted on one part of the luggage case;

a plurality of dial wheels rotatably mounted flat on said planar surface of said frame and arranged side by side in line with said opening, each dial wheel having a center hole and a plurality of code figures on an upper surface of said dial wheel and around said center hole and a bore in a bottom side of said dial wheel, said bore being coaxially formed with said center hole and provided with a plurality of recesses in the periphery of said bore;

a plurality of lock wheels corresponding with dial wheels, each lock wheel having a center rod extending axially through said center hole of respective dial wheel and a key member on said center rod, said key member being capable of selectively engaging and disengaging said recesses of said bore of respective dial wheel, a disc member provided with a radial slot, and a lower stem; each lock wheel being supported by a resilient member;

a retaining plate for retaining said lock wheels and said resilient members with respect to said frame, said retaining plate having a plurality of through holes to allow said lower stems of said lock wheels to extend therethrough, each through hole being provided with an elongated slot;

a lock plate having a hook member and being capable of moving in one direction to cause said hook member to engage a hasp member provided on another part of the luggage case and moving in an opposite direction to cause said hook member to disengage from said hasp member; a plurality of lug members extending from an upper side of said lock plate to correspond with said discs of said lock wheels, each lug extending through said elongated slot of said retaining plate and being capable of engaging respective radial slot of said disc member of said lock wheel when said lock wheels are rotated to align said radial slots with said lugs, said lugs being disposed adjacent to respective disc so as to prevent the movement of said lock plate when the lock plate is moved to cause said hook member to engage with said hasp member and said lock wheels are rotated to move said radial slots out of alignment with said lugs; said lock plate further having a knob extending through said opening of said frame, and a plurality of holes to correspond with said lower stems of said lock wheels when said lock plate is moved to a position where said hook member is caused to disengage from said hasp member; and a base for slidably holding said lock plate with respect to said frame.

2. A combination lock for a luggage case as recited in claim 1, wherein said disc member of each lock wheel is provided with a plurality of concaves formed around the periphery thereof, and a resilient member having a tongue adapted to fit one of said concaves to produce a lateral, resilient pressure which enables a click action when said lock wheel is rotated.

3. A combination lock for a luggage case as recited in claim 2 or 1, wherein said base is provided with a resilient an additional member adapted to urge said lock plate in position.

* * * * *